US006123298A

United States Patent [19]

Riley

[11] Patent Number: 6,123,298

[45] Date of Patent: Sep. 26, 2000

[54] MODEL RAILROAD TRACK ASSEMBLY WITH ACTUATOR LOCATED WITHIN HOLLOW TRACK BED

[75] Inventor: H. Lee Riley, Middletown, Del.

[73] Assignee: Bachmann Industries, Inc., Philadelphia, Pa.

[21] Appl. No.: 09/076,980

[22] Filed: May 13, 1998

Related U.S. Application Data

[63] Continuation of application No. 08/780,769, Jan. 8, 1997, Pat. No. 5,752,678.

[51] Int. Cl.[7] ..... E01B 7/00; E01B 23/00

[52] U.S. Cl. ..... 246/415 A; 104/DIG. 1; 238/10 B; 238/10 E; 238/10 R

[58] Field of Search ..... 104/DIG. 1; 238/10 R, 238/10 A, 10 B, 10 E; 246/415 A

[56] References Cited

U.S. PATENT DOCUMENTS

| | | | |
|---|---|---|---|
| 204,006 | 5/1878 | Condict, Jr. . | |
| 204,007 | 5/1878 | Condict, Jr. . | |
| 1,142,150 | 6/1915 | Dorrill . | |
| 1,482,637 | 2/1924 | Fergusson . | |
| 2,143,195 | 1/1939 | Kahn et al. . | |
| 2,272,903 | 2/1942 | Bonanno . | |
| 2,534,458 | 12/1950 | Larrabee . | |
| 2,615,125 | 10/1952 | Peabody . | |
| 2,665,848 | 1/1954 | Smith et al. . | |
| 2,665,849 | 1/1954 | Smith . | |
| 2,764,357 | 9/1956 | Katryniak . | |
| 2,765,581 | 10/1956 | Adler . | |
| 3,379,873 | 4/1968 | Casadio | 246/415 A |
| 3,566,104 | 2/1971 | Edwards . | |
| 3,650,468 | 3/1972 | Ewe et al. . | |
| 4,066,211 | 1/1978 | Mak . | |
| 4,084,746 | 4/1978 | Cheng . | |
| 4,091,995 | 5/1978 | Barlow et al. . | |
| 4,106,695 | 8/1978 | Carella et al. . | |
| 4,150,789 | 4/1979 | Tong . | |
| 4,179,066 | 12/1979 | Teter . | |
| 4,216,871 | 8/1980 | Rocereta | 104/DIG. 1 |

(List continued on next page.)

FOREIGN PATENT DOCUMENTS

| | | |
|---|---|---|
| 0014162 | 8/1980 | European Pat. Off. . |
| 2135202 | 2/1973 | Germany . |
| 646770 | 11/1950 | United Kingdom . |
| 0718825 | 11/1954 | United Kingdom . |
| 1564291 | 4/1980 | United Kingdom . |
| 2099317 | 12/1982 | United Kingdom . |

OTHER PUBLICATIONS

Atlas Tool Co., Inc., Packaging for Switch with instructions for conversion to remote control, admitted prior art.

*Primary Examiner*—S. Joseph Morano
*Assistant Examiner*—Robert J. McCarry, Jr.
*Attorney, Agent, or Firm*—Akin, Gump, Strauss, Hauer & Feld, L.L.P.

[57] ABSTRACT

A model railroad track assembly having a substantially rigid, one-piece molded plastic body with an upper surface molded to generally replicate at least a portion of a railroad track bed is provided. The track assembly has depending side walls extending generally downwardly from the upper surface to define a lower side having a hollow cavity. The body has at least two ends, with each end including a male latching member and a matingly complementary female engagement structure. The upper surface includes a molded-in guiding structure to receive and locate a preassembled piece of model railroad track, including at least two metal rails molded in place on a ladder-shaped member simulating a plurality of spaced-apart ties. The ends of the molded body are adapted for mating engagement with the ends of similar track assemblies having a similar piece of preassembled model railroad track with the rails on the engaged track ends being aligned. An actuator is positioned within the hollow cavity beneath the upper surface such that the actuator is contained within the cavity. The actuator is adapted to change a direction of travel of rolling stock traveling on the at least two rails or uncouple rolling stock traveling on the at least two rails.

8 Claims, 4 Drawing Sheets

U.S. PATENT DOCUMENTS

| | | | |
|---|---|---|---|
| 4,219,153 | 8/1980 | Cheng . | |
| 4,225,081 | 9/1980 | Ikegame . | |
| 4,695,016 | 9/1987 | Worack . | |
| 4,838,828 | 6/1989 | Ohnuma et al. . | |
| 4,898,326 | 2/1990 | Edwards et al. . | |
| 4,953,785 | 9/1990 | Keska . | |
| 4,955,537 | 9/1990 | Bratovz . | |
| 4,997,187 | 3/1991 | Smollar et al. . | |
| 5,085,148 | 2/1992 | Konno . | |
| 5,226,619 | 7/1993 | Alger | 246/415 A |
| 5,405,080 | 4/1995 | Yeung et al. . | |
| 5,503,330 | 4/1996 | Riley . | |
| 5,752,678 | 5/1998 | Riley | 246/415 A |

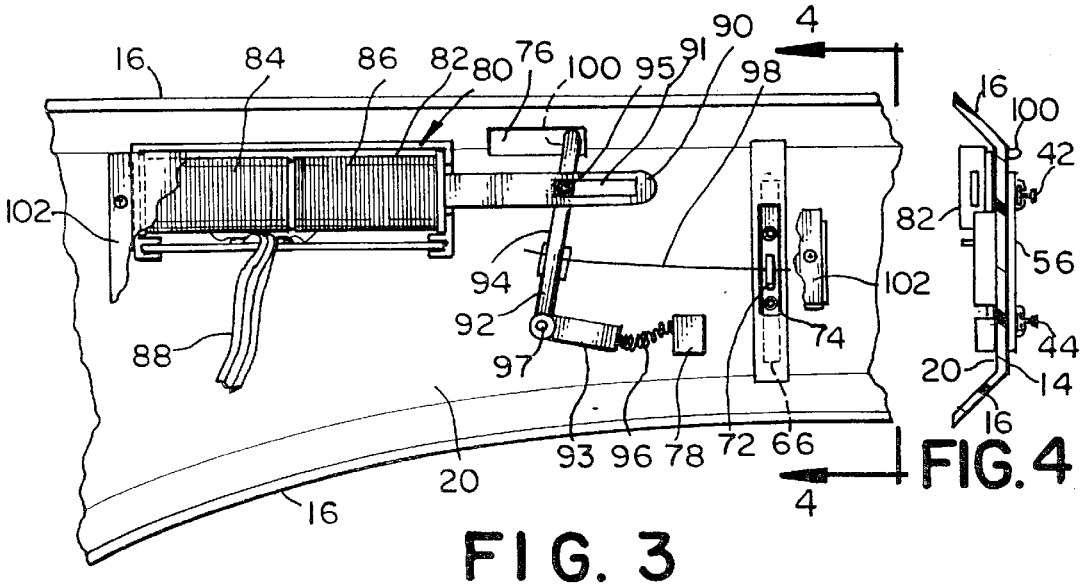
FIG. 4
FIG. 3
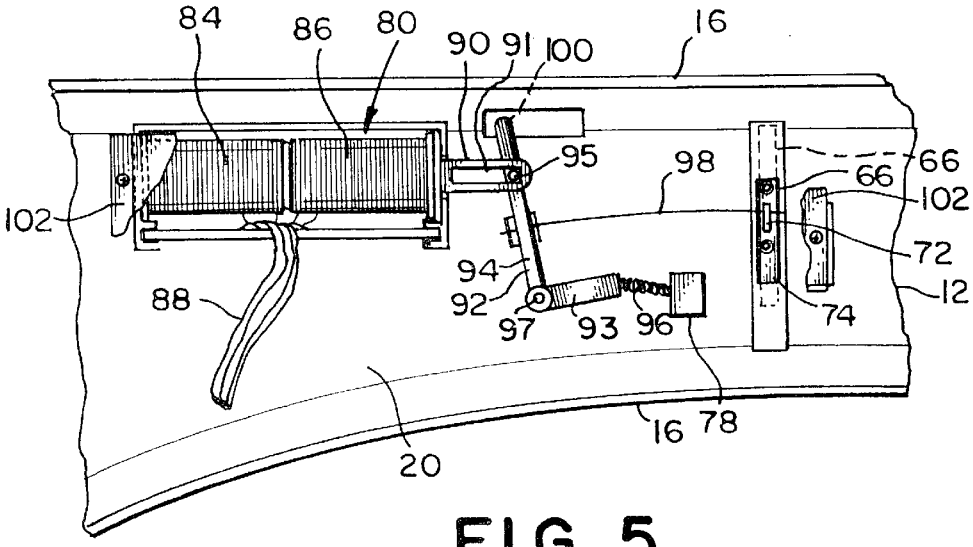
FIG. 5

MODEL RAILROAD TRACK ASSEMBLY WITH ACTUATOR LOCATED WITHIN HOLLOW TRACK BED

CROSS-REFERENCE TO RELATED APPLICATIONS

This application is a continuation of U.S. application No. 08/780,769, filed Jan. 8, 1997, now U.S. Pat. No. 5,752,678.

BACKGROUND OF THE INVENTION

The present invention relates to model railroad track, and more particularly, to model railroad track with a track bed which simulates ballast or other track bed materials.

In scale model railroading, there is a constant desire to provide functional miniaturized railroading equipment and accessories which are realistic scale reproductions of actual railroad equipment. However, due to the small size of the HO and N scale gauges, which are currently the most popular sizes, it is often difficult to provide realistic looking accessories which also perform their intended function.

Another problem associated with the smaller model track, such as HO and N, is that the track sections are typically connected together with tubular rail connectors which provide an electrical and mechanical connection between the rails. However, these connectors have not proven adequate to maintain the track sections together in use and it was therefore necessary to permanently mount track sets in such gauges to boards to assure that the rail sections did not become dislodged during use. This problem has been addressed by the assignee of the present invention by providing track assembly segments in which each segment includes the track and simulated ballast. The simulated ballast closely resembles ballast railroad beds and provides a molded support bed for the model railroad track with a separate mechanical latching mechanism to securely hold the track sections together.

One problem which has not been previously addressed is to provide model railroad switches which have a scale appearance as well as decouplers for uncoupling model railroad rolling stock. Of particular concern to hobbyists are switches which are used to selectively direct model rolling stock along first or second paths.

In the known switches, the switch motor and actuating mechanism are located adjacent to the track and are grossly out of scale in order to provide a functioning switch. Both manual and remotely actuated model railroad switches generally include a slide actuator, located in a housing located alongside the rails, having a serpentine slot which can be manually moved or driven by a switch motor between first and second positions. A first cross slide, having a follower which is positioned in the serpentine slot, is driven in a transverse direction to the cross slide by the serpentine slot acting on the follower. A flexible arm is connected between the first cross slide and a second cross slide. The two moveable track sections of the switch are connected to the second cross slide. Upon movement of the slide actuator, either by manual actuation or the switch motor, the first cross slide is moved in the transverse direction by the follower in the serpentine slot. This in turn moves the flexible beam which actuates the second cross slide to move the moveable switch rails. Aside from the housing and switch motor being out of scale, this arrangement can also present functional problems because the slide actuator has an intermediate zone where the moveable rails are in an intermediate location which could cause rolling stock traveling through the switch to derail if the slide actuator is not moved to one or the other extreme.

Similarly, use of automatic uncouplers for model railroad rolling stock generally requires mounting a magnet between the rails of the track for HO scale trains, or using a vertically moveable uncoupling device mounted between the rails for N scale trains. While these known uncoupling devices function, they present a problem for scale model railroaders since they are difficult to integrate into a model railroad layout while maintaining a scale appearance.

BRIEF SUMMARY OF THE INVENTION

Briefly stated, the present invention provides a model railroad track assembly having a substantially rigid, one-piece molded plastic body with an upper surface molded to generally replicate at least a portion of a railroad track bed, with depending side walls extending generally downwardly from the upper surface to define a lower side having a hollow cavity. The body has at least two ends, with each end including a male latching member and a matingly complementary female engagement structure. The upper surface includes a molded-in guiding structure. A preassembled piece of model railroad track is received in and located by the guiding structure. The model railroad track includes at least two metal rails molded in place on a ladder-shaped member simulating a plurality of spaced-apart ties. The ends of the molded body are adapted for mating engagement with the ends of similar track assemblies having a similar piece of preassembled model railroad track with the rails on the engaged track ends being aligned. An actuator is positioned within the hollow cavity beneath the upper surface such that the actuator is contained within the cavity. The actuator is adapted to change a direction of travel of rolling stock traveling on the rails or uncouple rolling stock traveling on the at least two rails.

In another aspect, the present invention provides a model railroad track switch assembly having a substantially rigid, one-piece molded plastic body with an upper surface molded to generally replicate at least a portion of a railroad track bed. The body includes depending side walls extending generally downwardly from the upper surface to define a lower side having a hollow cavity. The body has at least three connector ends, with each connector end including a male latching member and a matingly complementary female engagement structure. The upper surface of the body includes a molded-in guiding structure. A preassembled model railroad track switch is received in and located by the guiding structure. The switch includes metal rails molded in place on a plurality of spaced-apart ties, defining at least two selectable paths for model railroad rolling stock to travel through the switch. The switch includes two moveable rails which are moveable from a first position, which allows the model railroad rolling stock to travel along a first path through the switch, to a second position, which allows the model railroad rolling stock to travel along a second path through the switch. The ends of the molded body are adapted for mating engagement with the ends of track assemblies having a piece of preassembled model railroad track, with the rails on the engaged track ends being aligned. The moveable rails are pivotably mounted at a first end and are attached to a cross-slide member at a second end. A first spring is located in the hollow cavity which biases the cross-slide member to one a first position, which corresponds to the first position of the moveable rails, and a second position, which corresponds to the second position of the moveable rails.

In another aspect, the present invention provides a model railroad track assembly having a substantially rigid one-piece molded plastic body with an upper surface molded to generally replicate at least a portion of a railroad track bed. Depending side walls extend generally downwardly from the upper surface to define a lower side having a hollow cavity. The body has at least two ends, with each end including a male latching member and a matingly complementary female engagement structure. The upper surface includes a molded-in guiding structure to receive and locate a preassembled piece of model railroad track including two metal rails molded in place on a ladder-shaped member simulating a plurality of spaced-apart ties. The ends of the molded body are adapted for mating engagement with the ends of similar track assemblies having a similar piece of preassembled model railroad track, with the rails of the engaged track being aligned. A magnetic field source is positioned within the hollow cavity beneath the upper surface such that the magnetic field source is contained within the cavity below the upper surface. The magnetic field source is adapted to uncouple rolling stock traveling on the rails.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 3 is a bottom plan view of the enlarged detail portion of the model railroad track switch assembly shown in FIG. 2;

FIG. 4 is a cross-sectional view taken along line 4—4 in FIG. 3;

FIG. 5 is an enlarged bottom plan view similar to FIG. 3 illustrating a second position of the actuator;

DETAILED DESCRIPTION OF INVENTION

Figure 1:
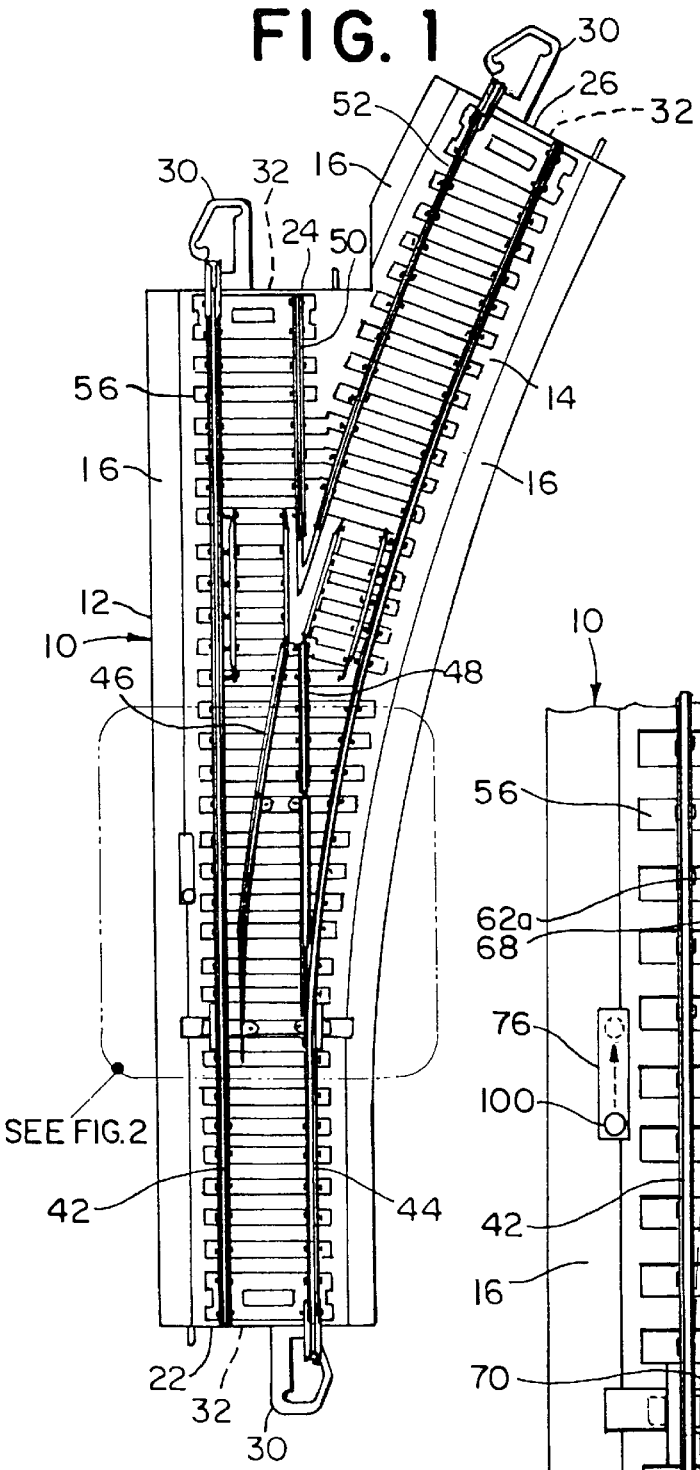
FIG. 1 is a top plan view of a first preferred embodiment of a model railroad track switch assembly in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the model railroad track assembly and designated parts thereof. The terminology includes the words above specifically mentioned, derivatives thereof and words of similar import.

Referring to the drawings, wherein like numerals indicate like elements throughout, there is shown in FIGS. 1–5, a first embodiment of a model railroad track assembly 10 in accordance with the present invention. The model railroad track assembly 10 includes a substantially rigid, one-piece molded plastic body 12 having an upper surface 14 molded to generally replicate at least a portion of a railroad track bed. Depending side walls 16 extend generally downwardly from the upper surface 14 to define a lower side having a hollow cavity 20. The body 12 has at least two ends 22, 24, and more preferably three ends 22, 24 and 26. Each end includes a male latching member 30 and a matingly complementary female engagement structure 32 (which is the same as element 232, shown in detail in FIG. 10). The upper surface 14 includes a molded-in guiding structure. A preassembled piece of model railroad track 40 is received in and located by he guiding structure. One piece molded plastic bodies of this type are described in detail in U.S. Pat. No. 5,503,330, which was invented by the present inventor and is assigned to the assignee of the present invention, and is incorporated herein by reference as if fully set forth. Accordingly, further detailed description of the plastic body 12 of the present invention, the male latching member 30 and the matingly complementary female engagement structure 32 is not believed to be necessary or limiting.

In the first preferred embodiment of the model railroad track assembly 10, preferably the preassembled piece of model railroad track 40 is a switch which includes at least two metal rails 42, 44, and more preferably includes six metal rails 42, 44, 46, 48, 50, 52. The metal rails 42, 44, 46, 48, 50, 52 are molded in place on a ladder-shaped member 56 which simulates a plurality of spaced-apart ties, which branches from the first end 22 to the second and third ends 24, 26. The first, second and third ends 22, 24 and 26 of the molded body 12 are adapted for mating engagement with the ends of similar track assemblies (not shown) having a similar piece of preassembled model railroad track. The similar track assemblies may be straight or curved track pieces, crossings or any other type of preassembled model railroad track. The rails 42, 44, 50, 52 on the engaged track ends are aligned with the ends of mating track pieces when engaged to provide a smooth transition for model rolling stock which travels on the track.

Figure 2:
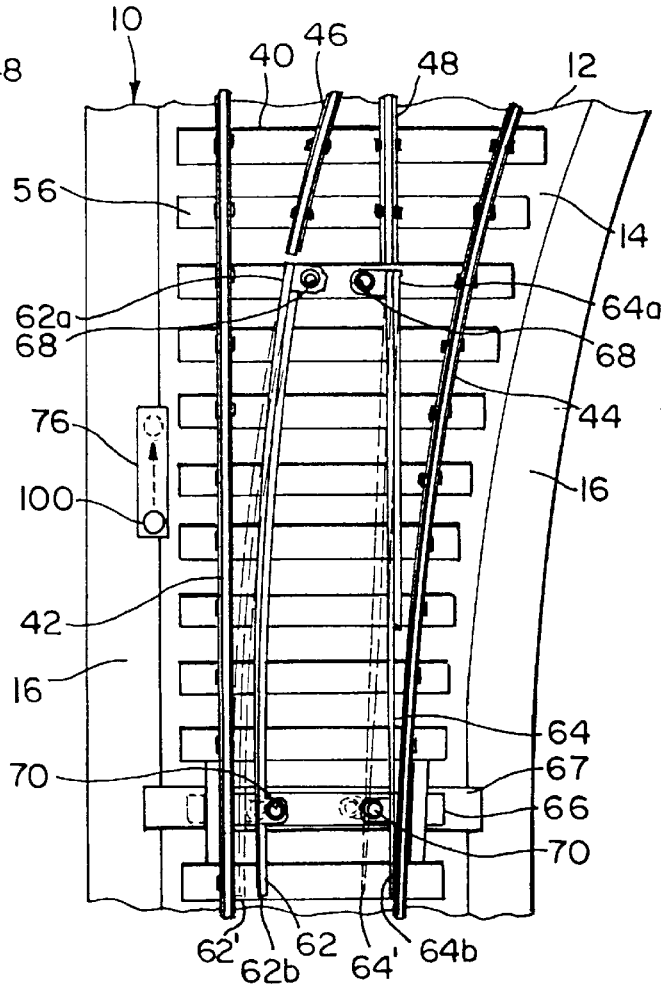
FIG. 2 is an enlarged detail of a portion of FIG. 1, as indicated in FIG. 1.

As shown in FIGS. 1 and 2, preferably the preassembled model railroad track switch 40 includes two moveable rails 62, 64 defining at least two selectable paths for model railroad rolling stock to travel through the switch 40. The moveable rails 62, 64 are pivotably connected at their first ends 62*a*, 64*a* to the ladder-shaped member 56 by pivot pins 68. The second ends 62*b*, 64*b* are pivotably attached to a cross-slide member 66 by pivot pins 70. The cross-slide member 66 is slidably positioned in a groove 67 beneath the rails 42, 44 and the moveable rails 62, 64. The moveable rails 62, 64 are moveable from a first position, as shown in FIG. 2, which allows rolling stock to travel straight through the switch along a first path from the first end 22 to the second end 24, to a second position, (shown in dashed lines and identified as 62', 64' in FIG. 2) which allows model rolling stock to travel along a second path through the switch from the first end 22 to the third end 26. Model rolling stock traveling in a reverse direction and entering the switch from the second or third ends 24, 26 would exit from the switch through the first end 22.

Referring now to FIGS. 3–5, an actuator 80 is positioned within the hollow cavity 20 beneath the upper surface 14 of the body 12. The actuator 80 is contained within the cavity 20, and is not visible or apparent from the upper surface 14 when the model railroad track assembly 10 is in the in-use position, as shown in FIG. 1. The actuator 80 is adapted to change a direction of travel of rolling stock traveling on the at least two rails 42, 44, or uncouple rolling stock traveling on the at least two rails 42, 44, as described in detail below. In the first embodiment 10, preferably the actuator 80 is used to change a direction of travel of rolling stock traveling on the least two rails 42, 44.

In the first embodiment of the model railroad track assembly 10, the two moveable rails 62, 64 are connected to the actuator 80. The two moveable rails 62, 64 are moveable by the actuator 80 between the first and second positions 62, 64 and 62', 64'. Preferably, the actuator 80 comprises a switch motor 82 which has a flattened, rectangular cross section, as shown in FIG. 4, with the height of the switch motor 82 being less than the height of the cavity 20 in the road bed defined by the plastic body 12. The switch motor 82 preferably consists of two adjacent coils of wire 84 and 86 which can be selectively energized via wires 88 which are connected to a switch and a power source (not shown). An iron core, which also has a flattened cross section to be received within the flattened coils of wire 84, 86, is slidably positioned inside the coils 84, 86 and can be selectively moved back and forth by selectively energizing the first or second coil 84, 86 to generate a magnetic field to move the iron core. Switch motors utilizing an iron core and coils in a solenoid arrangement, generally as described above, are known in the art. But none of the known switch motors have a low profile with a flattened coil configuration such that the height of the switch motor 82 is less than the height of the cavity 20 in the body 12, so that the switch motor 82 can be hidden from view to present a more realistic scale model railroad switch.

Preferably, the switch motor 82 is connected by a first link 90, which is connected to and extends from the slidable iron core in the switch motor 82, to a pivotably mounted switch linkage 92 located within the cavity 20. As shown in FIG. 3, the switch linkage 92 includes a first arm 93 and a second arm 94 which extends transversely from the first arm 93. A first spring 96 located in the hollow cavity 20 biases the switch linkage 92 to one of a first and second switch linkage position, shown in FIGS. 4 and 5. The moveable rails 62, 64 are connected to the switch linkage 92, and are similarly biased by the first spring 96 to one of the first and second positions shown in FIG. 2. A resilient arm 98 is connected between the switch linkage 92 and the moveable rails 62, 64. The resilient arm 98 provides a non-rigid contact between the moveable rails 62, 64 and the respective fixed rails 42, 44 such that, upon reverse movement of rolling stock through a non-selected switch branch, (i.e., rolling stock entering the switch 10 through the second or third ends 24, 26, and exiting through the first end 22) wheels on the rolling stock temporarily displace the moveable rails 62, 64 by deflecting the resilient arm 98 to prevent the derailment of the rolling stock.

In the first preferred embodiment, the first spring 96 is a coil spring which is connected between a fixed support member 100 attached to the body 12 and the free end of the first arm 93. The coil spring 96 is at least partially compressed throughout the entire range of motion, and biases the switch linkage 92 to one of the first and second positions, as shown in FIGS. 3 and 5. Preferably, the first link 90 includes a slot 91, and a pin 95 protrudes from the second arm 94 of the switch linkage 92 into the slot 91.

Preferably, the resilient arm 98 is connected to the cross-slide member 66 via an eye 72 which extends through an opening 74 in the upper surface 14 of the body 12 into the hollow cavity 20. The opening 74 is of sufficient size to allow movement of the cross-slide member 66 to allow movement of the moveable rails 62, 64 between the first and second positions. Preferably, a second opening 76 is defined through the body 12, and a manually operable lever 100 connected to the actuator 80 extends through the second opening 76. Preferably, the lever 100 is connected to the second arm 94 of the switch linkage 92. In the first preferred embodiment, a cover 102, shown partially broken away in FIGS. 3 and 5, covers the actuator 80, the switch linkage 92, the first spring 94 and the resilient arm 98.

While the switch 10 in accordance with the first embodiment of the invention is a right hand switch, it will be recognized by those skilled in the art from the present invention that the switch could also be provided as a left hand switch or a three way switch, if desired. It will be similarly recognized that while the preferred switch motor is a solenoid arrangement, any type of actuator, such as a drive motor or pneumatic cylinder could be used as the switch motor, if desired. Additionally, the switch linkage 92 can be made of any suitable material, such as a polymeric or metallic material.

In use, the model railroad track switch assembly 10 provides a more realistic scale model of an actual switch since the switch motor 82 is located in the hollow cavity 20 in the plastic body 12. The switch can be actuated by providing current to the first or second coils 84, 86 of the switch motor 82 to generate a magnetic field which acts on and moves the iron core. This moves the first link 90, which is connected to the iron core, between the first and second positions, shown in FIGS. 3 and 5. The switch can also be manually actuated via switch lever 100, if desired. The slot 91 in the first link 90 allows manual movement of the switch linkage 92 without necessarily moving the first link 90.

Figure 6:
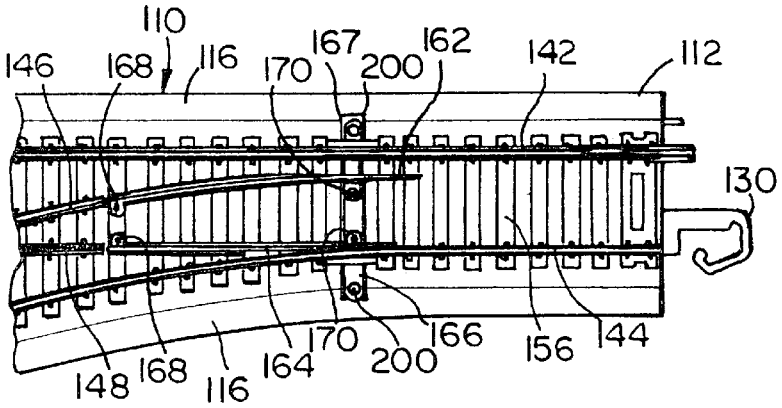
FIG. 6 is a partial top plan view of a second embodiment of a model railroad track switch assembly in accordance with the present invention.
Figure 7:
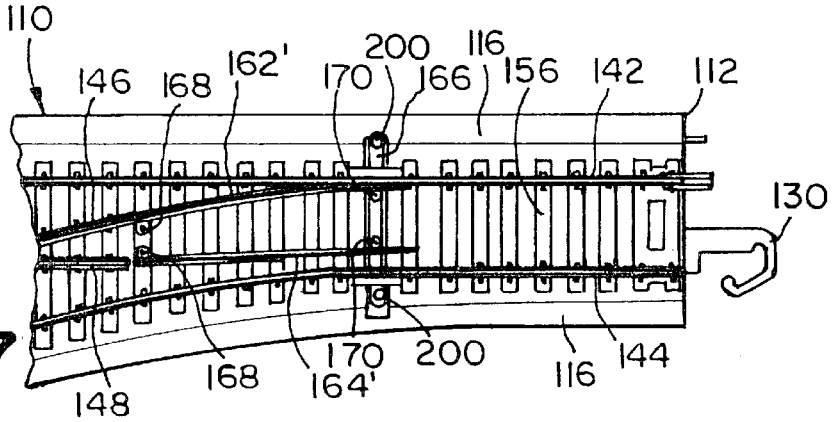
FIG. 7 is a partial top plan view similar to FIG. 6 showing the moveable rails in a second position.
Figure 8:
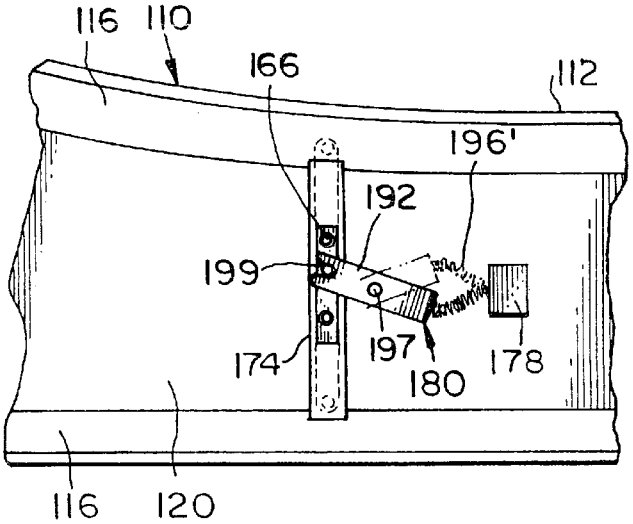
FIG. 8 is an enlarged partial bottom plan view of the second embodiment of the invention shown in FIG. 6.

Referring now to FIGS. 6–8, a second embodiment of a model railroad track assembly 110 in accordance with the present invention is shown. The second embodiment 110 of the present invention is also a model railroad track switch assembly, similar to the first embodiment 10, and like elements have been identified with similar element numbers which include the prefix "1". For example, the plastic body 112 of the second embodiment 110 is similar to the plastic body 12 of the first embodiment 10. The differences between the first and second embodiments 10, 110 of the present invention are described in detail below.

The model railroad track switch assembly 110 in accordance with the second embodiment of the invention is a manual switch assembly and includes moveable rails 162, 164 which are moveable between a first position, shown in FIG. 6, and a second position, shown in FIG. 7. For illustration purposes, the model railroad tracks switch assembly 110 has been illustrated as a left-hand switch, in comparison to the right-hand switch illustrated in connection with the first embodiment 10. However, it will be understood by those of ordinary skill in the art from the present disclosure that 155 left or right-hand switch assemblies can be made in accordance with the first and second embodiments of the invention, if desired.

When the moveable rails 162, 164 are in the first position, shown in FIG. 6, the switch 110 allows model rolling stock to travel along a first path, straight through the switch 110. In the second position, shown in FIG. 7, the moveable rails 162', 164' are positioned such that model rolling stock can travel along a second path through the switch 110, which branches away from the first path. The moveable rails 162, 164 are pivotably attached to the ladder-shaped member 156 by pivot pins 168 at the first end and are pivotably attached by pivot pins 170 to the cross-slide member 166. The cross-slide member 166 is slidably mounted beneath the fixed rails 142, 144 and the moveable rails 162, 164 in a groove 167 in the plastic body 112. Preferably, manual actuator levers 200 are located on either side of the cross-slide member 166.

Referring now to FIG. 8, an actuator 180 comprised of a first spring 196, which is preferably a compression spring, is mounted between a fixed support 178 located in the hollow cavity 120 and the first end of a switch linkage 192. The switch linkage 192 is pivotably mounted on a pivot pin 197. A pin 199 extends downwardly into the hollow cavity 120 from the cross-slide member 166 through an opening 174 in the plastic body 112. The first spring 196 biases the moveable rails 162, 164 to one of the first and second positions, shown in FIGS. 6 and 7 as 196 and 196', due to the force of the spring 196 forcing the switch linkage 192 to move to an off-centered position. This prevents the cross-slide member 166 and the moveable rails 162, 164 from inadvertently remaining between the first and second positions which could cause the derailment of rolling stock traveling through the switch 110. Additionally, upon reverse movement of rolling stock through a non-selected switch branch, (i.e., rolling stock entering the switch 110 through the second or third ends 124, 126, and exiting through the first end 122) wheels on the rolling stock temporarily displace the moveable rails 162, 164 by deflecting the first spring 196 to prevent the derailment of the rolling stock.

Figure 10:
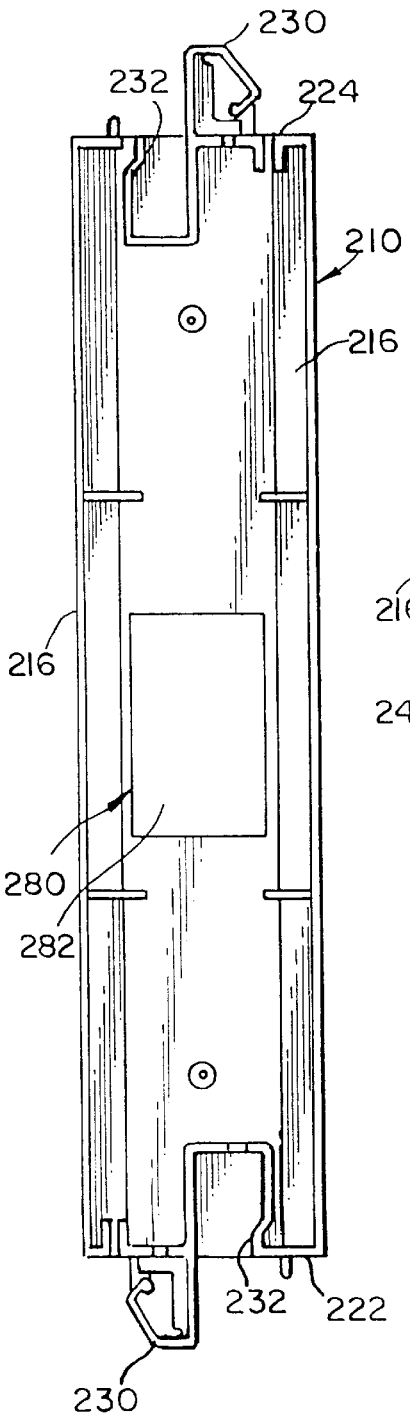
FIG. 10 is a bottom plan view of the third embodiment of the invention shown in FIG. 9.
Figure 9:
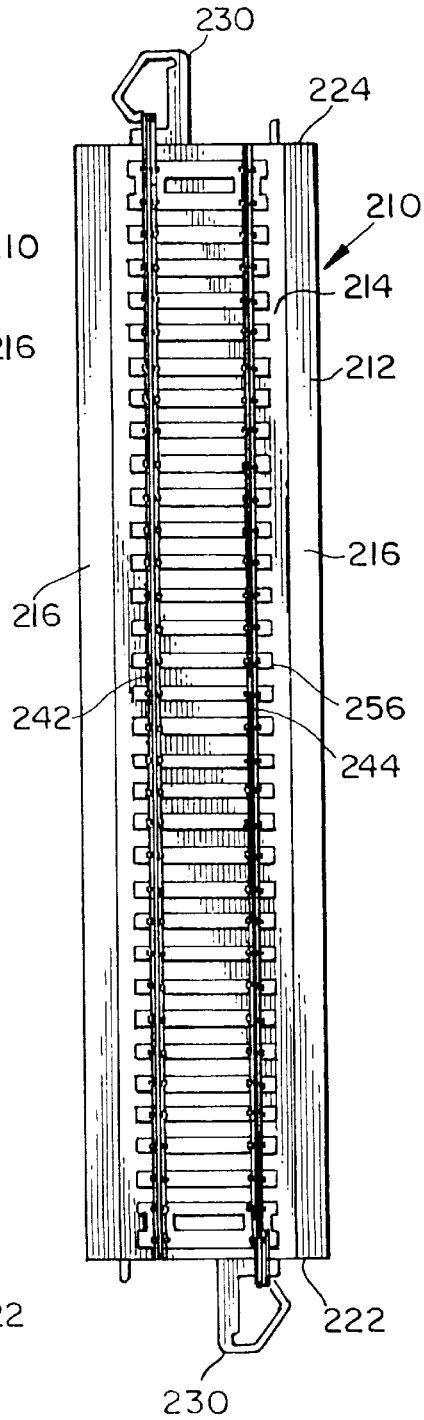
FIG. 9 is a top plan view of a third embodiment of the model railroad track assembly.

Referring now to FIGS. 9 and 10, a third embodiment of the present invention 210 is shown in detail. The model railroad track assembly 210 in accordance with the third preferred embodiment comprises a substantially rigid, one-piece molded body 212 having an upper surface 214 molded to generally replicate at a portion of a railroad track bed. Depending side walls 216 extending generally downwardly from the upper surface 215 to define a lower side having a hollow cavity 220. The body 212 has two ends 222, 224, with each end including a male latching member 230 and a matingly complementary female engagement structure 232. The upper surface includes a molded-in guiding structure. A preassembled piece of model railroad track 240 is received by and located in the guiding structure. The track 240 includes at least two metal rails 242, 244 molded in place on a ladder-shaped member 256 simulating a plurality of spaced-apart ties.

The ends 222, 224 of the molded body 212 are adapted for mating engagement with ends of similar track assemblies having a similar piece of preassembled model railroad track with the rails on the engaged track ends being aligned. A detailed description of railroad track assemblies as generally described above is provided in U.S. Pat. No. 5,503,330 of the present inventor, which is assigned to the assignee of the present invention, and is incorporated herein by reference as if fully set forth.

Referring to FIG. 10, an actuator 280 is positioned within the hollow cavity 220 beneath the upper surface 214 such that the actuator 280 is contained within the cavity 220 and is not visible from the upper surface 214. The actuator 280 is adapted to uncouple rolling stock traveling on the at least two rails 242, 244. In the third embodiment 210 of the present invention, the actuator is a permanent magnet 282 having a magnetic field which is adapted to actuate magnetically actuated couplers on rolling stock to uncouple two engaged couplers. Magnetically actuated couplers and their operation are generally known to those of ordinary skill in the art. One such magnetically actuated coupler is provided in U.S. Pat. No. 5,509,546 which is assigned to the assignee of the present invention and is incorporated herein by reference as if fully set forth.

Preferably, the polarity of the magnet 282 is parallel to the rails with the poles being continuous along the side edges to cause a magnetically actuated post on a magnetically actuated coupler to pivot outwardly when activated by the magnet. The permanent magnet has a height which is less than the height of the hollow cavity 220 such that the magnet 282 is located within the hollow cavity 220 and is hidden from view when the track is in the normal operating position, as shown in FIG. 9. This provides a scale appearance for track having a magnetic actuator for uncoupling rolling stock without the need for cutting holes in track support or locating the magnet on top of the ties.

The magnet 282 can be provided pre-assembled in the cavity 220 of model railroad track assembly 210, or can be provided as a kit, with magnet 282 and an adhesive, which can be separate or pre-coated on one surface of the magnet, for assembly by the user onto a track assembly having a molded one-piece body 212, a cavity 220, and a preassembled piece of model railroad track 240. Additionally, a flat holder with a model signal man or other marker can be provided in the kit, such that the holder is held in place with the magnet 282, and extends out from beneath the cavity 220 to position the signal man adjacent to the magnet 282 to provide a visual indication to the model railroad operator as to the position of the magnetic decoupler.

Figure 11:
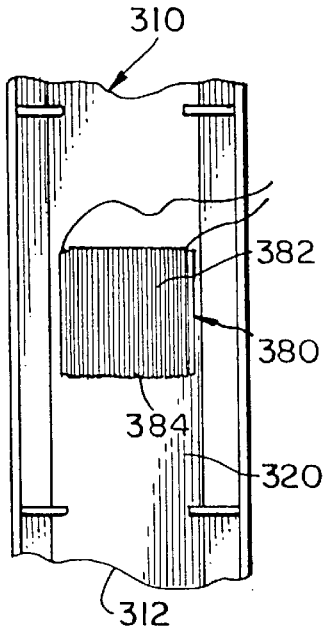
FIG. 11 is a partial bottom plan view, similar to FIG. 10, showing a fourth embodiment of the invention.

Referring now to FIG. 11, a model railroad track assembly in accordance with a fourth preferred embodiment 310 of the present invention is shown. The model railroad track assembly 310 in accordance with the fourth preferred embodiment is similar to the third preferred embodiment 210.

The difference between the third and fourth embodiments 210 and 310 is described in detail below.

As seen in FIG. 11, the model railroad track assembly 310 in accordance with the fourth preferred embodiment includes an actuator 380 which is preferably an electromagnet 382 which generates a magnetic field to uncouple magnetically actuated couplers on rolling stock to uncouple two engaged couplers. The operation of the fourth preferred embodiment is similar to the third preferred embodiment except that the electromagnet 382 can be selectively actuated to prevent unintentional uncoupling of rolling stock as it travels along the model railroad track section. Preferably, the electromagnet 382 is comprised of a coil of wire 384 which is connected to a DC power source which can be switched on and off, as desired.

The electro-magnet 382 can be provided preassembled with the model railroad track 310, or can be provided separately, as a kit, for assembly by the user to a piece of model railroad track 310 inside the cavity 320, in a similar manner to that described above in connection with the third embodiment 210. A flagman or other marker is preferably provided with the kit to act as a visual indicator for the operator to identify where the decoupler is located.

It will be recognized by those of ordinary skill in the art from the present disclosure that the actuators of the present invention can be mounted under straight or curved track sections or can be used in connection with crossings, switches or any other type of track section, if desired, as long as a plastic body 12, 112, 212, 312 having a hollow cavity 20, 120, 220, 320 is provided in order to provide a more realistic scale model railroad layout. Other types of actuators for performing other functions can also be mounted in the hollow cavity, if desired, such as an actuator to detect the presence of a model train engine to actuate crossing guards.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A model railroad track assembly for model railroads, comprising:

a substantially rigid, one-piece molded plastic body having an upper surface molded to generally replicate at least a portion of a railroad track bed, with depending side walls extending generally downwardly from the upper surface to define a lower side having a hollow cavity, the body having at least two ends, each end including a male latching member and a matingly complementary female engagement structure, the upper surface including a molded-in guiding structure, a preassembled piece of model railroad track received by and located in the guiding structure, the preassembled piece of model railroad track including at least two metal rails molded in place on a ladder-shaped member simulating a plurality of spaced-apart ties, the ends of the molded body being adapted for mating engagement with the ends of track assemblies each having a piece of preassembled model railroad track, with rails on track ends in said mating engagement being aligned, an actuator having a flattened cross section with a height which is less than a height of the roadbed is positioned within the cavity beneath the upper surface such that the actuator is contained within the cavity, the actuator being adapted to uncouple rolling stock traveling on the rails.

2. The model railroad track assembly of claim 1 wherein the actuator is a permanent magnet.

3. The model railroad track assembly of claim 1 wherein the actuator is an electro-magnet.

4. A model railroad track assembly comprising:

a substantially rigid, one-piece molded plastic body having an upper surface molded to generally replicate at least a portion of a railroad track bed, with depending side walls extending generally downwardly from the upper surface to define a lower side having a hollow cavity, the body having at least two ends, each end including a male latching member and a matingly complementary female engagement structure, the upper surface including a molded-in guiding structure, a preassembled piece of model railroad track received by and located in the guiding structure, the preassembled piece of model railroad track including at least two metal rails molded in place on a ladder-shaped member simulating a plurality of spaced-apart ties, the ends of the molded body being adapted for mating engagement with the ends of track assemblies each having a piece of preassembled model railroad track, with rails on track ends in said mating engagement being aligned, and a magnetic field source positioned within the cavity beneath the upper surface such that the magnetic field source is contained within the cavity and is not visible from the upper surface, the magnetic field source being adapted to uncouple rolling stock traveling on the rails.

5. The model railroad track assembly of claim 4 wherein the magnetic field source is a permanent magnet.

6. The model railroad track assembly of claim 4 wherein the magnetic field source is an electromagnet.

7. A method of automatically uncoupling model railroad rolling stock having magnetically actuated couplers, comprising:

(a) providing a substantially rigid, one-piece molded plastic body having an upper surface molded to generally replicate at least a portion of a railroad track bed, with depending side walls extending generally downwardly from the upper surface to define a lower side having a hollow cavity, the body having at least two ends, each end including a male latching member and a matingly complementary female engagement structure, the upper surface including a molded-in guiding structure, a preassembled piece of model railroad track received by and located in the guiding structure, the preassembled piece of model railroad track including at least two metal rails molded in place on a ladder-shaped member simulating a plurality of spaced-apart ties, the ends of the molded body being adapted for mating engagement with the ends of track assemblies each having a piece of preassembled model railroad track, with rails on track ends in said mating engagement being aligned;

(b) positioning a magnetic field source within the cavity beneath the upper surface such that the magnetic field source is contained within the cavity and is not visible from the upper surface;

(c) providing a visible indicator which is visible to a model railroad operator which identifies the magnetic field source location; and (d) at least momentarily reversing a direction of model railroad rolling stock traveling over the magnetic field source to actuate the magnetically actuated couplers in proximity to the magnetic field source to uncouple.

8. A model railroad track switch assembly comprising:

a substantially rigid, one-piece molded plastic body having an upper surface molded to generally replicate at least a portion of a railroad track bed, with depending side walls extending generally downwardly from the upper surface to define a lower side having a hollow cavity, the body having at least three connector ends, each connector end including a male latching member and a matingly complementary female engagement structure, the upper surface including a molded-in guiding structure, a preassembled model railroad track switch received in and located by the guiding structure, the switch including metal rails molded in place on a plurality of spaced-apart ties defining at least two selectable paths for model rolling stock to travel through the switch, and two movable rails which are movable from a first position, which allows the model rolling stock to travel along a first path through the switch, to a second position, which allows the model rolling stock to travel along a second path through the switch, the ends of the molded body being adapted for mating engagement with the ends of track assemblies having a piece of preassembled model railroad track with the rails on the engaged track ends being aligned, the movable rails being pivotally mounted at a first end, and being attached to a slide member at a second end, and a first spring located in the hollow cavity which biases the slide member to one of a first position, which corresponds with the first position of the movable rails, and second position, which corresponds to the second position of the movable rails.

* * * * *